US005997593A

United States Patent [19]

McDonnell et al.

[11] Patent Number: 5,997,593

[45] Date of Patent: Dec. 7, 1999

[54] FUELS WITH ENHANCED LUBRICITY

[75] Inventors: Thomas F. McDonnell, Grosse Ile, Mich.; Anthony J. Rollin, Midlothian, Va.

[73] Assignee: Ethyl Corporation, Richmond, Va.

[21] Appl. No.: 09/219,167

[22] Filed: Dec. 22, 1998

[51] Int. Cl.[6] ..... C10L 1/22

[52] U.S. Cl. ..... 44/421

[58] Field of Search ..... 44/417, 420, 421

[56] References Cited

U.S. PATENT DOCUMENTS

| | | | |
|---|---|---|---|
| 2,373,049 | 4/1945 | Pedersen | 44/417 |
| 2,584,784 | 2/1952 | Biswell | 44/420 |
| 2,657,984 | 11/1953 | Braithwaite, Jr. et al. | 44/417 |
| 3,615,294 | 10/1971 | Von Allmen | 44/417 |
| 3,655,560 | 4/1972 | Andress, Jr. | 252/51.5 |
| 3,677,726 | 7/1972 | Coran et al. | 44/417 |
| 3,749,702 | 7/1973 | Boelringer et al. | 44/417 |
| 4,295,982 | 10/1981 | Frangatos | 44/420 |
| 4,416,669 | 11/1983 | Graiff et al. | 44/417 |
| 4,536,189 | 8/1985 | Sung | 44/56 |
| 4,948,523 | 8/1990 | Hutchison et al. | 252/47 |
| 5,035,720 | 7/1991 | Weers | 44/343 |
| 5,152,807 | 10/1992 | Sexton et al. | 44/420 |
| 5,292,351 | 3/1994 | DeRosa et al. | 44/417 |
| 5,336,277 | 8/1994 | Poirier et al. | 44/343 |

*Primary Examiner*—Jacqueline V. Howard

*Attorney, Agent, or Firm*—Dennis H. Rainear; Thomas Hamilton

[57] ABSTRACT

A reaction product of at least one $C_5$–$C_{60}$ carboxylic acid and at least one amine selected from the group consisting of guanidine, aminoguanidine, urea, thioruea and the salts thereof is disclosed as an additive for hydrocarbon fuels. The reaction product is added to a fuel, such as gasoline, at levels of from about 5 pounds of reaction product per thousands barrels of fuel (PTB) to about 100 PTB to increase the lubricity of the fuel and thereby reduce the wear occasioned upon the fuel pump. A composition comprising a hydrocarbon fuel and the reaction product is also disclosed.

16 Claims, No Drawings

FUELS WITH ENHANCED LUBRICITY

TECHNICAL FIELD

The present invention relates to fuel compositions comprising an additive for hydrocarbon fuels, such as gasoline and diesel fuel, that increases the lubricity of the fuel without adding factors that would damage the fuel system of a vehicle using said fuel compositions or cause an increase in undesirable combustion by-products.

BACKGROUND OF THE INVENTION

Problems associated with fuel lubricity arose in the mid-1960's when a number of aviation fuel pump failures occurred. After considerable research, it was realized that advances in the refining of aviation turbine fuel had resulted in the almost complete removal of the naturally occurring lubricating components from the fuel. The removal of these natural lubricants resulted in the seizure of fuel pump parts. By the mid-1980's, it seemed likely that a similar problem was imminent in diesel fuel pumps. Fuel injection pump pressures had been steadily increasing while there was also a growing concern to reduce the sulfur content of the diesel fuel. The desire to reduce the sulfur content of the diesel fuel, in an effort to reduce pollution, required the use of more rigorous fuel refining processes. It was determined that as refining processes became more stringent, the naturally occurring oxygen containing compounds and polyaromatics which contribute to diesel fuel's inherent lubricity were eliminated. In response to these developments, a number of effective lubricity additives were developed for diesel fuels. These additives are now widely used to enhance the lubricity of highly refined, low sulfur diesel fuels.

Gasoline fuels are also becoming subject to compositional constraints, including restrictions on sulfur content, in an effort to reduce pollutants. The principle concern is the effect of sulfur on exhaust catalyst life and performance. The lubricity requirements of gasoline are somewhat lower than for diesel fuel since the majority of gasoline fuel injection systems inject fuel upstream of the inlet valves and thus operate at much lower pressures than diesel fuel pumps. However, as automobile manufacturers desire to have electrically powered fuel pumps within the fuel tanks, failure of the pumps can be expensive to repair. These problems are also likely to increase as injection systems become more sophisticated and the gasoline fuels become more highly refined.

Additional pump wear concerns have arisen with the introduction of vehicles having gasoline direct injection engines (GDI) since the fuel pumps for these vehicles operate at significantly higher pressures than traditional gasoline fuel pumps.

Another area subject to pump wear and failure is the use of submerged fuel pumps in gasoline or diesel fuel storage tanks. It is important to reduce the wear of these submerged pumps due to the difficulty of getting to these pumps for repair and maintenance.

Many commercially available gasoline fuels contain gasoline detergents such as polyisobutylene amine and polyether amine. These compounds are known to have a minor effect on the wear properties of the fuel. A growing number of commercially available gasoline fuels contain oxygenates, such as methyltertiarybutylether (MTBE). These oxygenates are known to increase rates of wear of fuel pump components as they have very high friction coefficients. In light of the desire for more highly refined fuels, lower sulfur content and oxygenation of the fuels, there is presently a need for lubricity improvers for hydrocarbon fuels in order to obtain acceptable fuel pump life. The present invention solves these problems by adding the reaction product of a carboxylic acid and at least one amine selected from the group consisting of guanidine, aminoguanidine, urea and thioruea to the fuel.

U.S. Pat. No. 3,655,560 to Andress, Jr. discloses fuels and lubricants containing aminoguanidine-based antioxidants. The basic teaching of this patent is that agents selected from ketimines of aminoguanidine, aldimines of ketimines of aminoguanidine and aldimines of amides of aminoguanidine are useful in inhibiting the oxidation of liquid hydrocarbon fuels and hydrocarbon lubricants. This patent does not address the lubricity issues of petroleum based fuels and the agents disclosed as useful antioxidants are not the same as the lubricity additives disclosed herein.

U.S. Pat. No. 4,536,189 to Sung discloses an anti-corrosion additive for motor fuels containing a minor amount of a short-chain aliphatic alcohol. The anti-corrosion additive is prepared by reacting maleic anhydride and a hydrocarbon substituted mono-primary amine. This reference is primarily concerned with fuel compositions containing minor amounts of short chain alcohols, such as methanol, that have high corrosion activity and which may cause the metallic parts of the fuel system to corrode or rust. This patent does not address the problems associated with wear in fuel pumps caused by a decrease in lubricity of the fuel.

Hutchison et al., in U.S. Pat. No. 4,948,523, discloses a lubricating composition that contains a silver protective agent. The silver protective agent comprises the reaction product of a $C_5$–$C_{60}$ carboxylic acid and at least one amine selected from the group consisting of: 1) guanidine, urea and thioruea compounds; 2) $C_1$–$C_{20}$ hydrocarbyl or hydroxy-substituted hydrocarbyl mono-amines, alkylene diamines; and 3) polyalkylene polyamines and N-alkyl glycine. This patent is directed to lubricating oil additives for medium speed diesel engines, such as locomotive engines, which have silver parts in the engine. Large, medium-speed diesel engines often contain silver protected components, such as bearings, and, as such, the lubricating oils may not contain the typical zinc containing wear inhibitors which attack the silver coated parts. This patent does not teach the addition of the lubricity additives of the present invention to fuels or address the lubricity problems associated with modem petroleum based fuels which have low sulfur, polyaromatics and oxygenate content.

U.S. Pat. No. 5,035,720 to Weers discloses a composition for use as a corrosion inhibitor in petroleum based fuels. The composition of Weers is an adduct of a triazole and a basic nitrogen compound selected from polyamines, alkoxyamines, aryloxyamines and monoalkyleneamines. This patent is primarily directed to additives to protect copper and aluminum surfaces of the vehicle fuel system from corrosion.

U.S. Pat. No. 5,336,277 to Poirier et al. discloses a composition for reducing in-tank fuel pump copper commutator wear. Poirier et al. disclose a fuel having an oil soluble triazole-amine adduct and at least one organomercaptan compound which, in combination with a metal deactivator, increases the resistance of the fuel composition to cause copper commutator wear.

An article by Ping et al. entitled: "Comparison of the Lubricity of Gasoline and Diesel Fuels", *Society of Automotive Engineers, Inc.,* (1996), provides a number of test methodologies to measure the friction and wear properties of petroleum based fuels. While this article does not suggest or disclose the presently claimed additives for increasing fuel lubricity, it does provide substantial background on the testing of fuels for lubricity.

While the prior art is replete with numerous treatments for fuels and lubricants, it does not suggest or disclose the present additive that provides adequate lubricity to the fuel and thereby reduce the incidence of fuel pump failure.

SUMMARY OF THE INVENTION

The present invention relates to the treatment of a hydrocarbon fuel in order to substantially reduce the wear occasioned upon fuel pumps used to pump said hydrocarbon fuels. The present invention also relates to the discovery that the addition of an additive obtained by reacting at least one amine selected from guanidine, aminoguanidine, urea and thioruea with at least one $C_5$–$C_{60}$ carboxylic acid will significantly reduce fuel pump wear as compared to a similar fuel that has not been treated with said additive. Further, the present invention provides an additive that is economical, will not damage the fuel system, nor will it cause an increase in the level of undesirable combustion products.

Thus, there is disclosed a fuel composition comprising a major amount of a hydrocarbon fuel and a minor amount of the reaction product(s) of at least one $C_5$–$C_{60}$ carboxylic acid and at least one amine selected from the group consisting of guanidine, aminoguanidine, urea, thioruea and salts thereof. This reaction product unexpectedly decreases the fuel composition's ability to cause wear to fuel pump components that come into contact with said fuel composition. The reaction product is preferably present in the fuel in an amount within the range of from about 5 pounds of reaction product per thousand barrels of fuel (PTB) to about 100 PTB. More preferably, the reaction product is present in an amount within the range from about 10 PTB to about 50 PTB, most preferably, from about 15 PTB to about 40 PTB. Preferably, the carboxylic acid ranges from $C_{10}$–$C_{40}$ and most preferably, from $C_{15}$–$C_{25}$.

There is also disclosed a method for reducing the wear of fuel pumps through which a hydrocarbon fuel is pumped, comprising adding a fuel-soluble additive to said fuel wherein the fuel-soluble additive comprises the reaction product of at least one $C_5$–$C_{60}$ carboxylic acid and at least one amine selected from the group consisting of guanidine, aminoguanidine, urea, thioruea and salts thereof and wherein the reaction product is added to the fuel in an amount of at least 5 PTB. The fuel compositions of the present invention are particularly suitable for reducing fuel pump wear in fuel pumps containing carbon brushes and copper commutators.

Also disclosed is a fuel composition comprising a liquid hydrocarbon fuel and a lubricity additive, said lubricity additive comprising the reaction product of a $C_5$–$C_{60}$ carboxylic acid and an amine compound of the general structure:

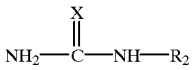

wherein X=$NR_1$, O or S wherein $R_1$ is H or $C_1$–$C_{15}$ hydrocarbyl; $R_2$ is H,—NR'R" or $C_1$–$C_{20}$ hydrocarbyl or hydroxy-substituted hydrocarbyl wherein R' and R", being the same or different, are H or $C_1$–$C_{20}$ hydrocarbyl or hydroxy-substituted hydrocarbyl; or salts of said compounds.

In view of the problems discussed above, a general aspect of the present invention is to provide a fuel additive to protect the fuel pump from excessive wear and breakdown. A further aspect of the invention is to provide a fuel additive suitable for addition to a fuel that does not damage the fuel system nor cause an increase in undesirable combustion products. Yet another aspect of the invention is to provide a fuel additive that works in conjunction with other additives such as detergents so that the life of the internal combustion engine, and especially the fuel pump, can be extended.

DETAILED DESCRIPTION OF THE INVENTION

The reaction product(s) useful as lubricity additives in the fuel compositions of the present invention are fuel-soluble reaction products obtained by reacting at least one amine compound with at least one $C_5$–$C_{60}$ carboxylic acid. The amine compound(s) is selected from the group consisting of guanidine, aminoguanidine, urea, thioruea and salts thereof. The amines useful in preparing the reaction product(s) have the general formula:

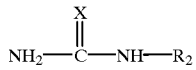

wherein X is —$NR_1$, O or S, wherein $R_1$ is H or $C_1$–$C_{15}$ hydrocarbyl; R2 is H, —NR'R" or C1 to C20 hydrocarbyl or hydroxy-substituted hydrocarbyl wherein R' and R" (being the same or different) are H or $C_1$ to $C_{20}$ hydrocarbyl or hydroxy-substituted hydrocarbyl; or salts of said compounds.

An advantage of the present invention is that the additive reaction product does not adversely impact upon the activity of other fuel additives such as detergents and octane boosters. Further, the additives according to the invention do not detrimentally impact the combustion properties of the fuel nor do they contribute contaminating factors to the combustion gases. Further, the additives of the present invention are highly effective and thus, a low treat rate is possible to achieve a desired level of lubricity performance, thus providing an economic mechanism to extend the useful life of fuel pumps.

Generally speaking, the additive reaction products described for use in the fuels according to the present invention can be obtained by reacting at least one $C_5$–$C_{60}$ aliphatic carboxylic acid with at least one amine selected from guanidine, aminoguanidine, urea, thioruea and salts thereof. Preferred for use in the present invention are the inorganic salts of aminoguanidine compounds wherein the anion is halide, carbonate, nitrate, phosphate, orthophosphate and the like. A particularly preferred aminoguanidine derivative for the preparation of the additive used in the present invention is aminoguanidine bicarbonate. The guanidine, aminoguanidine, urea and thioruea used herein are readily available from commercial sources or can be readily prepared using well known techniques.

The reaction temperature for the reaction between of the amine and the carboxylic acid is in the range from about 50° C. to 190° C. Examples of carboxylic acids suitable for preparing the additive reaction products of the present invention include the saturated aliphatic monocarboxylic acids such as valeric, caproic, caprylic, lauric, palmitic, stearic and the like. Saturated aliphatic dicarboxylic acids such as glutaric, adipic and the like are also useful. Cycloaliphatic acids, unsaturated aliphatic monocarboxylic acids such as oleic, linoleic and mixtures thereof and unsaturated dicarboxylic acids may also be used. Unsaturated dicarboxylic acids are also useful in the present invention. If a dicarboxylic acid is used, then 2 moles of the amine can be reacted per mole of carboxylic acid. The dimerized fatty acids, preferably those containing conjugated unsaturation, are also useful in preparing the inventive additives.

Representative of the carboxylic acids useful herein include the commercially available fatty acids or mixtures thereof, derived from sources such as corn oil, soybean oil, palm oil, tung oil, sunflower oil, cottonseed oil, palm kernel oil, olive oil and the like. Particularly preferred are the mono-carboxylic unsaturated fatty acids such as oleic acid, linoleic acid and mixtures thereof. As used herein and in the claims, the term "carboxylic acid" includes the reactive derivatives thereof such as the carboxylic acid anhydrides.

The reaction between the amine and the carboxylic acid is a condensation reaction. In carrying out the reaction, the mole ratio of the amine to carboxylic acid can be in the range from about 0.6:1 to about 1.3:1 and is preferably 0.9:1 to about 1:1. A reaction temperature of from about 50° to about 190° C. is acceptable and the range of about 90 to about 150° C. is preferred. Reaction times can range from about 1 hour to about 10 hours and preferably from about 1.5 to about 4 hours. The reaction can be carried out in any suitable solvent, a preferred solvent being toluene.

The characterization of the reaction product obtained by reacting the carboxylic acid with the amine is not exactly known. In a preferred embodiment, the lubricity additive of the present invention is obtained by reacting oleic acid with aminoguanidine bicarbonate. The principal component of the reaction product of aminoguanidine and oleic acid is an aminoguanidine oleamide. However, the reaction product will typically contain minor proportions of other species.

The fuel compositions of the present invention may contain supplemental additives in addition to the lubricity additive reaction products described above. Said supplemental additives include detergents, dispersants, cetane improvers, antioxidants, carrier fluids, metal deactivators, dyes, markers, corrosion inhibitors, biocides, antistatic additives, drag reducing agents, demulsifiers, dehazers, anti-icing additives, antiknock additives, anti-valve-seat recession additives, additional lubricity additives and combustion improvers.

Cyclopentadienyl manganese tricarbonyl compounds such as methylcyclopentadienyl manganese tricarbonyl are preferred combustion improvers because of their outstanding ability to reduce tailpipe emissions such as NOx and smog forming precursors and to significantly improve the octane quality of gasolines, both of the conventional variety and of the "reformulated" types.

The base fuels used in formulating the fuel compositions of the present invention include any base fuels suitable for use in the operation of spark-ignition or compression-ignition internal combustion engines such as diesel fuel, jet fuel, kerosene, leaded or unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Oxygenates suitable for use in the present invention include methanol, ethanol, isopropanol, t-butanol, mixed C1 to C5 alcohols, methyl tertiary butyl ether, tertiary amyl methyl ether, ethyl tertiary butyl ether and mixed ethers. Oxygenates, when used, will normally be present in the base fuel in an amount below about 25% by volume, and preferably in an amount that provides an oxygen content in the overall fuel in the range of about 0.5 to about 5 percent by volume.

The examples given below illustrate the novel fuel compositions of the present invention. Unless otherwise specified, all proportions are given by weight. The following examples are not intended or should not be construed as limitations of the invention as presently claimed.

EXAMPLE I

Preparation of Aminoguanidine Oleamide

A 5 liter, 3-neck flask was charged with 847.5 grams (3 moles) oleic acid, 3 moles of aminoguanidine bicarbonate, 300 mls of toluene and 15 drops of a silicone anti-foam agent. The reaction mixture was heated to reflux under a nitrogen blanket. Vigorous foaming was noted as carbon dioxide gas evolved. When the foaming subsided, water evolution began. A total of about 57 ml of water was collected from the reaction by means of a Dean-Stark trap. The temperature of the reaction mixture was raised to about 140° C. to facilitate the removal of toluene. The reaction product, believed to be primarily aminoguanidine oleamide, was filtered and placed under nitrogen for storage.

EXAMPLE II

Testing of the Additive

A commercially available, unleaded, regular gasoline without an additive package was obtained. To this base gasoline was added various detergents, carrier fluids and the experimental compound. The composition of each sample is set out in Table I.

TABLE I

| Sample | Detergent A* PTB | Detergent B** PTB | Carrier+ PTB | Reaction Product Ex 1 - PTB |
|---|---|---|---|---|
| 1 | 0 | 0 | 0 | 0 |
| 2 | 90 | 0 | 90 | 0 |
| 3 | 0 | 90 | 90 | 0 |
| 4 | 0 | 90 | 90 | 20 |

*HiTEC ® 4956 detergent commercially available from Ethyl Corporation, Richmond, Virginia.
**HiTEC ® 4997 detergent commercially available from Ethyl Corporation, Richmond, Virginia.
+600W oil Carrier Fluid from Exxon.

The purpose of this experiment was to evaluate the anti-wear characteristics of commercially available fuel detergents against the additive of the present invention. The anti-wear characteristics were compared in Walbro Gerotor fuel pumps. The fuel pumps were standard production fuel pumps as used in automobiles. Three pumps were tested in each sample for 1000 hours. Pump pressure was approximately 450 kpa for the continuous run. The fuel temperature was maintained at about 49° C. and a fuel change occurred approximately every 96 hours. Performance of the pumps, such as flow performance, current consumptions and the like, was evaluated at 24, 500 and 1000 hours and measurements were taken of the brushes in the electric motors and of the commutator at 0 and 1000 hours.

After 1000 hours of continuous operation the commutator was measured for wear as were the brush lengths for both the positive and negative poles of the motors. The expected life for the pumps was estimated based upon brush length. The formula used to calculate expected life in hours is set forth below.

$$\text{Expected life (hours)} = \left(\frac{\text{Failure brush length (0.380 in.)}}{\text{Starting Brush length (in)} - \text{Ending brush length (in)}}\right) \times \text{Durability hours}$$

Table II sets out the average brush measurements for all three pumps and the average calculated life expectancy for all three pumps after 1000 hours of operation with the fuels set forth in Table I. The standard deviations are also set forth.

TABLE II

Brush Measurements and Life Expectancy of Fuel Pump

| Sample | | Initial Length (in) | | | 1000 Hour Length (in) | | | Expected Life (Hours) | |
|---|---|---|---|---|---|---|---|---|---|
| # | | + | − | | + | − | | + | − |
| 1 | AVG. | 0.5585 | 0.5662 | AVG. | 0.4400 | 0.4425 | AVG. | 3234 | 3077 |
| | STDS | 0.0117 | 0.0102 | STDS | 0.0112 | 0.0103 | STDS | 351.52 | 136.63 |
| 2 | AVG. | 0.5638 | 0.5710 | AVG. | 0.4792 | 0.4368 | AVG. | 5257 | 2867 |
| | STDS | 0.0046 | 0.0097 | STDS | 0.0340 | 0.0282 | STDS | 2724.37 | 373.76 |
| 3 | AVG. | 0.5550 | 0.5617 | AVG. | 0.4730 | 0.4595 | AVG. | 4857 | 3837 |
| | STDS | 0.0085 | 0.0074 | STDS | 0.0265 | 0.0287 | STDS | 1372.50 | 842.56 |
| 4 | AVG. | 0.5707 | 0.5652 | AVG. | 0.5287 | 0.5460 | AVG. | 10880 | 22628 |
| | STDS | 0.0015 | 0.0028 | STDS | 0.0183 | 0.0067 | STDS | 6016.21 | 10580.30 |

Table II indicates that there is no statistical difference between Samples 1 and 3 and Samples 1 and 2 for the thousand hour positive brush length. It should be understood that in each motor, there are two brushes; 1 positive and 1 negative and that wear of these brushes correlates to the lubricity of the fuel as the more abrasive fuels cause greater wear of the brushes due to increased friction. Further, there was no statistical difference between Samples 1 and 2 for the one thousand hour negative brush length and no statistical difference between the one thousand hour negative brush length between Samples 1 and 3. However, there was a statistical difference between Sample 1 (base fuel) and Sample 4 (Fuel composition according to the invention), for both the one thousand hour positive brush length and the one thousand hour negative brush length, thus corresponding to a greatly increased pump life.

EXAMPLE III

The high frequency reciprocating rig (HFRR) was modified to evaluate gasoline lubricity. This gasoline lubricity test was developed based upon a standard procedure for diesel fuel lubricity. The apparatus and the procedure used are described as follows. A steel ball is attached to an oscillating arm assembly and is mated to a steel disk specimen in the HFRR sample cell. The sample cell contains 1–2 ml of the fuel being tested. A load of 500 grams is applied to the ball/disk interface by dead weights. The ball assembly is oscillated over a 1 mm path at a rate of 20 Hertz. These conditions ensure that a fluid film does not build up between the ball and disk. After a prescribed period of time, the steel ball assembly is removed. Wear, and hence the lubricity of the fuel, is assessed by measuring the mean wear scar diameter (MWSD) on the ball, resulting from oscillating contact with the disk. The lower the wear scar obtained the greater the lubricity of the fuel.

Since gasoline is more volatile than diesel fuel, the procedure was modified by maintaining a constant temperature of 25° C. This method can be used on reference fuels, such as heptane and iso-octane, or on fully formulated commercial gasolines. The base fuel used in the following examples was iso-octane.

TABLE III

HFRR results

| | Detergent[1] (ppm v/v) | Lubricity additive of Example 1 (ppm v/v) | MWSD (μm) |
|---|---|---|---|
| 1* | 0 | 0 | 202 |
| 2* | 165 | 0 | 108 |
| 3 | 165 | 20 | 85 |

*Comparative Example

[1]Mannich dispersant commercially available from Ethyl Corporation.

It is clear, upon examination of the data in Table III, that the fuel composition containing the additives of the present invention significantly reduce the wear scar on the ball and hence exhibit improved lubricity as compared to base fuel alone and base fuel plus a dispersant.

As natural lubricity of gasoline is on a noticeable decline since refining has become more severe in order to produce "low emissions gasolines", a fuel additive is required by the industry to ensure that fuel pumps will accomplish an acceptable working lifetime. Although diesel fuel pumps and injectors operate under more stringent conditions than gasoline fuel pumps (15,000 to 30,000 psi vs. 40–60 psi for gasoline engines), there is a trend in the automotive industry to increase fuel system pressures, such as in the case of GDI engines (1000 to 2000 psi), and thus the demands made upon gasoline fuel pumps will increase.

In certain regions of the United States such as California, "low emission", highly oxygenated gasoline blends will put further abrasive demands upon fuel pumps. Gasoline fuel pump failures will continue to increase and therefore the industry is presently searching for an additive that will overcome this problem. The automotive industry is thus in need of a lubricity agent for fuels as they become harsher as a result of increased refining to achieve lower emissions. Further, commercialization of gasoline direct injection technology equipped vehicles with gasoline fuel pumps operating at much higher injection pressures will require careful consideration of gasoline lubricity properties. Thus, the present invention addresses these needs in an efficient and economical manner.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as formation of the lubricity additive reaction products) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations is thus wholly immaterial for an accurate understanding and appreciation of this disclosure and the claims thereof.

As used herein the term "fuel-soluble" means that the substance under discussion should be sufficiently soluble at 20° C. in the base fuel selected for use to reach at least the minimum concentration required to enable the substance to serve its intended function. Preferably, the substance will have a substantially greater solubility in the base fuel than this. However, the substance need not dissolve in the base fuel in all proportions.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A composition comprising a major proportion of a liquid hydrocarbon fuel and a minor proportion of a reaction product of at least one $C_5$–$C_{60}$ carboxylic acid and at least one amine selected from the group consisting of aminoguanidine and salts thereof.

2. The fuel composition of claim 1 wherein said reaction product is present in the fuel composition in an amount within the range of from 5 pounds of reaction product per thousand barrels of fuel (PTB) to about 100 PTB.

3. The fuel composition of claim 2 wherein said reaction product is present in an amount within the range from 10 PTB to 50 PTB.

4. The fuel composition of claim 3 wherein said reaction product is present in an amount within the range of 15 PTB to 40 PTB.

5. The fuel composition of claim 1 wherein said carboxylic acid is a $C_{10}$–$C_{40}$ carboxylic acid.

6. The fuel composition of claim 5 wherein said carboxylic acid is a $C_{15}$–$C_{25}$ carboxylic acid.

7. The fuel composition of claim 1 wherein said carboxylic acid is oleic acid.

8. The fuel composition of claim 1 wherein said reaction product is the reaction product of aminoguanidine bicarbonate and oleic acid.

9. A method for reducing the wear of fuel pumps through which a liquid hydrocarbon fuel is pumped, comprising adding a fuel-soluble additive to said fuel, said fuel-soluble additive comprising the reaction product of at least one $C_5$–$C_{60}$ carboxylic acid and at least one amine selected from the group consisting of aminoguanidine and salts thereof.

10. The method of claim 9 wherein said reaction product is present in said fuel in a concentration of at least 5 PTB.

11. The method of claim 10 wherein said carboxylic acid is a $C_{10}$–$C_{40}$ carboxylic acid.

12. The method of claim 10 wherein said carboxylic acid is oleic acid.

13. The method of claim 10 wherein said reaction product is the reaction product of aminoguanidine bicarbonate and oleic acid.

14. A fuel composition comprising a liquid hydrocarbon fuel and a lubricity additive, said lubricity additive comprising the reaction product of a $C_5$–$C_{60}$ carboxylic acid and a compound of the general structure:

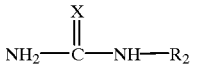

wherein X is —$NR_1$ wherein $R_1$ is H; $R_2$ is H,—NR'R" wherein R' and R", being the same or different, are H or $C_1$–$C_{20}$ hydrocarbyl or hydroxy-substituted hydrocarbyl; or salts of said compounds.

15. The fuel composition of claim 14 wherein said lubricity additive is present in said fuel at a concentration of at least 5 PTB.

16. The fuel composition of claim 14 wherein said lubricity additive is present in said fuel at a concentration of about 10 to 50 PTB.

* * * * *